US008465228B2

(12) United States Patent
Doleshal

(10) Patent No.: US 8,465,228 B2
(45) Date of Patent: Jun. 18, 2013

(54) PILE CLEANER APPARATUS

(76) Inventor: Donald L. Doleshal, Olathe, KS (US)

( * ) Notice: Subject to any disclaimer, the term of this patent is extended or adjusted under 35 U.S.C. 154(b) by 509 days.

(21) Appl. No.: 12/798,872

(22) Filed: Apr. 13, 2010

(65) Prior Publication Data

US 2010/0226724 A1 Sep. 9, 2010

Related U.S. Application Data

(60) Provisional application No. 61/214,006, filed on Apr. 17, 2009.

(51) Int. Cl.
*B05B 13/02* (2006.01)

(52) U.S. Cl.
USPC ..... 405/211; 15/104.04

(58) Field of Classification Search
USPC ..... 405/195.1, 211, 211.1; 15/104.03, 15/104.04
See application file for complete search history.

(56) References Cited

U.S. PATENT DOCUMENTS

| | | | | |
|---|---|---|---|---|
| 1,134,881 | A | | 4/1915 | Lockwood |
| 1,266,051 | A | | 5/1918 | Reynolds |
| 1,680,372 | A | | 8/1928 | Fenn |
| 2,960,706 | A | | 11/1960 | Dunham |
| 3,734,048 | A | | 5/1973 | Michaelsen |
| 4,895,205 | A | | 1/1990 | Thompson et al. |
| 5,040,923 | A | | 8/1991 | Do |
| 5,069,234 | A | * | 12/1991 | Nielsen ..... 15/104.04 |
| 5,136,969 | A | * | 8/1992 | Chapman ..... 15/104.04 |
| 5,458,683 | A | * | 10/1995 | Taylor et al. ..... 15/104.04 |
| 5,520,734 | A | * | 5/1996 | Taylor et al. ..... 15/104.04 |
| 5,765,968 | A | | 6/1998 | Lee |
| 6,023,807 | A | * | 2/2000 | Beissner ..... 15/104.04 |
| 6,371,696 | B1 | * | 4/2002 | Eathorne ..... 405/211 |
| 7,442,256 | B2 | * | 10/2008 | Sela et al. ..... 15/104.04 |

OTHER PUBLICATIONS

StoneAge Waterjet Tools drawing of "Assy, Piling Cleaner" dated Jul. 3, 2006, but not confirmed, attached.

* cited by examiner

*Primary Examiner* — Tara M. Pinnock
(74) *Attorney, Agent, or Firm* — Kenneth W. Iles

(57) ABSTRACT

A supporting ring is clamped about a pile and a cleaning ring is supported below the clamping ring by a cable threaded through a number of pulleys, allowing the washing ring assembly to be raised or lowered along a pile. A washing ring carries a four high-pressure water jets that spray water against the pile while the washing ring oscillates through 110-120 degrees of arc, driven by a hydraulic motor through a gear ring. A stabilizing ring fits into a C-shaped channel formed by the washing ring, supporting the cable pulleys. Both the washing ring and the stabilizer ring can be broken down into two semi-circular sections, required for installation and removal in most applications, and are fastened together by a number of over-center clamps.

14 Claims, 9 Drawing Sheets

PILE CLEANER APPARATUS

CROSS-REFERENCE TO RELATED APPLICATIONS

This application claims the benefit of U.S. Provisional Patent Application No. 61/214,006 under 35 U.S.C. 119(e).

STATEMENT REGARDING FEDERALLY SPONSORED RESEARCH OR DEVELOPMENT

Not applicable.

SEQUENCE LISTING

Not applicable

BACKGROUND OF THE INVENTION

The present invention is related to an apparatus and process for automatically cleaning piles or the like.

DESCRIPTION OF THE RELATED ART INCLUDING INFORMATION DISCLOSED UNDER 37 C.F.R. 1.97 and 1.98.

As used herein, a "pile" is a heavy beam or post, typically driven vertically into the bed of the river, soft ground, etc., to support the foundations of a superstructure. More particularly, the term pile refers to such a post that is driven into the ground beneath water, typically ocean water near a shore where a portion of the pile will be submerged in the earth below the water and a portion will be above the water to support a dock or the like. Typically, a dock or the like is supported by a large number of piles. In the splash zone, that is, the zone about six to 8 feet below the normal placid water level and above that level to the point that wave action touches the piles, marine action causes significant accumulation of marine debris, such as marine animals and plants, corrosion, erosion and the like. This debris must be removed before any structural inspection or remediation such as jacketing or the like can be undertaken.

A common prior art approach is to send divers into the water with high powered water jets to blast marine debris from the piles. This approach is dangerous and largely ineffective. Most commonly, the water around the piles is turbulent and murky —so murky that a diver cannot see more than about a foot and a half in front of him. The currents make it hard for the diver to stay in one place, particularly after turning on the high powered water jet which may utilize water under 1500 pounds per square inch pressure, creating about 150 pounds of backward thrust which naturally tends to push the diver backward. The work is arduous and the water is often very cold. Consequently, work shifts are necessarily brief. Because it is disorienting to be underwater and unable to see, a diver can lose track of his position relative to the pile and the position of the water jet and the direction of the water being expelled from it. This leads to two serious disadvantages. First, piles cleaned by this method are rarely cleaned well. Second, it is not uncommon for a diver to injure himself, even severing fingers or toes by inadvertently pointing the water jet at his own body.

Inventors have patented devices that endeavor to address these problems, some of which are discussed below.

U.S. Pat. No. 5,765,968, issued to Lee on Jun. 16, 1998, discloses an Apparatus for Eliminating and Preventing Marine Growth on Offshore Structures, comprising a ring that is placed about a circular cross section pile and is closed by a clasp or link 3, and a number of rollers 2 about the ring that contact the pile and allow the ring to rotate about the ring. The ring has two semi-circular segments. A number of sharp blades are attached to the outside of the ring to catch currents and cause the ring 1 to rotate or oscillate and rock back and forth randomly. A number of these rings can be connected together, one below the other by vertical connecting members and can be maintained in a desired position by a number of floats fixed to an upper ring. A number of brushes, which can be made in a variety of shapes and sizes, scrap the pile as the rings are moved about by wave action.

U.S. Pat. No. 5,040,923, issued to Do on Aug. 20, 1991, discloses an Apparatus for the Prevention of Marine Growth of Offshore Structures comprising a ring composed of straight-line segments connected together, which has brush segments to scrap the pile as currents move the ring. Only water waves and currents provide power to the apparatus. A number of these rings can be connected together vertically by the vertical tubular connectors. In construction and operation it is very similar to Lee '968 above. Both this apparatus and the apparatus of Lee '968, above, depend entirely on water currents for motion and, therefore, scrubbing action on the pile, which will be unpredictable in intensity and duration. Further the force on brushes will also be unpredictable and likely insufficient to clean debris from the pile.

The time required to clean a pile will be unpredictable and will vary, as to the same pile, from day to day.

Brushes are also utilized in U.S. Pat. No. 2,960,706 for a Pile Cleaning and Treatment Device, issued to Dunham on Nov. 22, 1960, which has powered brushes and includes nozzles mounted inside drum for spraying creosote or other toxic coating material onto the pile, and U.S. Pat. No. 1,134,881 for a Pile Protecting Device, issued to Lockwood on Apr. 6, 1915, which includes a heavy circular ring with brushes projecting toward the center of the circle and which is placed about a pile, dropping by the force of gravity and simultaneously brushing the pile. A related device that uses a loose chain placed around the pile at its base and connected to floats that rise through the water and thereby drag the chain along the side walls of the pile is disclosed in U.S. Pat. No. 1,266,051 for a Pile Cleaner and Protector, issued to Reynolds on May 14, 1918.

Systems that utilize wave action to move brushes do not provide predictable cleaning action and results and that can be controlled as to the force of the cleaning action and the time used for cleaning a pile. These systems also cannot operate above the water line, but corrosion, marine life encrustation and the like also occur in the splash zone above the normal waterline. Therefore, there is a need for an automatic pile cleaner that thoroughly cleans piles; that can be controlled by an operator and that provides predictable cleaning times and that can clean piles above the normal waterline.

BRIEF SUMMARY OF THE INVENTION

Accordingly, it is a primary object of the present invention to provide a pile cleaner apparatus that thoroughly cleans piles.

It is another object of the present invention to provide a pile cleaner apparatus that can be controlled as to the force of the cleaning action and the time used for cleaning a pile.

It is another object of the present invention to provide a pile cleaner apparatus that can by an operator and that provides predictable cleaning times.

It is another object of the present invention to provide a pile cleaner apparatus that can clean piles above the normal waterline.

These and other objects of the present invention are achieved by providing an automatic device for gripping the pile and cleaning it by high-pressure water jetting from a number of high-pressure water jets mounted on an oscillating washing ring, typically three or four jets. The device cleans a small area and then automatically moves itself downward along the pile a set distance, all the while cleaning the pile with the high-pressure water spray. This sequence is repeated until the entire pile is cleaned. Then the upper ring, or clamping ring is loosened from the pile and automatically pulled to the top of the pile by hydraulically driven wheels moved into tight contact with the pile by hydraulic cylinders.

An upper clamping ring is connected to a lower washing ring, which includes an oscillating jet supporting ring. The upper clamping ring is clamped firmly to the pile by hydraulic pressure from hydraulic cylinders and the washing ring is suspended from it by a cable threaded through a number of pulleys attached to the clamping ring and to the washing ring, which is lengthened to lower the washing ring and shortened to raise the washing ring, both through operation of a hydraulic winch. High pressure water is forced through the water jets mounted in the water jet ring with the jets pointed toward the pile. The water jet ring oscillates so that four water jets mounted 90° apart on the water jet ring spray against all 360° of the circumference of the pile. When that section is cleaned, the winch lowers the washing ring an incremental amount, lower clamping ring is loosened and pushed downward by hydraulic pressure. The cable is extended until the length of the pile has been cleaned. Then the cable drawn onto the winch drum, hauling the washing ring upward until it is adjacent tot he clamping ring, which is then loosened and the drive wheels are engaged against the pile, actuated and used to pull the pile cleaner apparatus upward to a point where it can be removed from the pile.

The clamping ring is split along a diameter into two semi-circular sections, each with outward projecting flanges at the end of the segment, allowing a the clamping ring to form a collar, which is placed about a pile in the two sections, which are then clamped together to grip the pile tightly. The washing ring assembly is similarly disassembled into semi-circular sections, which are installed about a pile and then secured into a cylinder by a set of over-center clamps.

Other objects and advantages of the present invention will become apparent from the following description taken in connection with the accompanying drawing, wherein is set forth by way of illustration and example, the preferred embodiment of the present invention and the best mode currently known to the inventor for carrying out his invention.

DETAILED DESCRIPTION OF THE INVENTION

Figure 1:
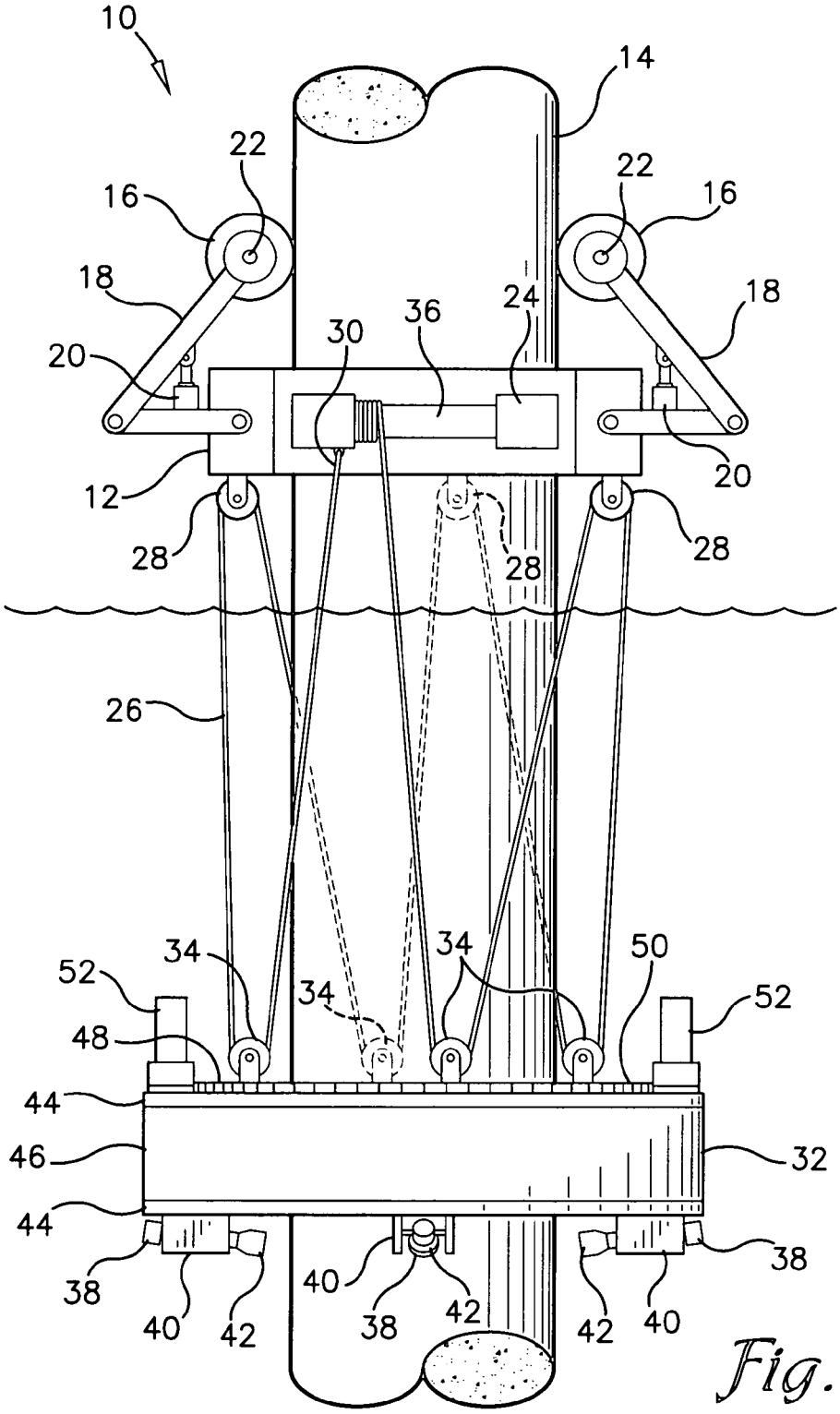
FIG. 1 is a front view a pile cleaner apparatus according to the present invention shown mounted on a cylindrical pile ready for use.

Referring to FIG. 1, a pile cleaner apparatus 10 according to the present invention includes an upper clamping ring 12 connected to a pile 14 by the clamping hydraulic cylinders that squeeze the two semi-circular sections together against the pile 14. A pair of drive wheels 16 are connected to the clamping ring 12 by the pivoting arms 18 that allow the drive wheels 16 to be pressed against the pile 14 or moved out of contact with it by the hydraulic cylinders 20. The wheels 12 are rotated by the hydraulic drive motors 22 to raise the apparatus above the water line for removal.

Still referring to FIG. 1, a hydraulic winch 24 fastened to the clamping ring 12 carries a cable 26 that is threaded through clamping ring pulleys 28 and is tied off at the fitting 30 on the clamping ring 12. A washing ring assembly 32 is suspended from the clamping ring 12 by the cable 26 threaded through the washing ring assembly pulleys 34. As the winch draws the cable 26 onto the winch drum 36, thereby shortening it, the washing ring assembly 32 is pulled upward along the pile 14 and as the winch 24 plays out the cable 26, the washing ring assembly is lowered along the pile 14.

Still referring to FIG. 1, the washing ring assembly 32 carries four high-pressure water jets 38, each mounted in a water jet bracket 40 and having a nozzle 42 to direct water jets against the pile 14, thereby scouring marine debris from it. The high pressure water is supplied to the water jets 38 by conventional means not shown. The nozzles are mounted on the washing ring 44 section of the washing ring assembly 32, which oscillates relative to the stationary stabilizer ring 46, which includes a top wall portion 48 to which the pulleys 34 are fastened. A ring gear 50 is bolted to a correspond top wall portion of the washing ring 44 and is driven by the two hydraulic motors 52, which have drive shafts, each connected to a small drive gear that meshes with the ring gear 50, thereby causing the washing ring to move in a pattern determined by the operator or by the hydraulic control system.

Figure 2:
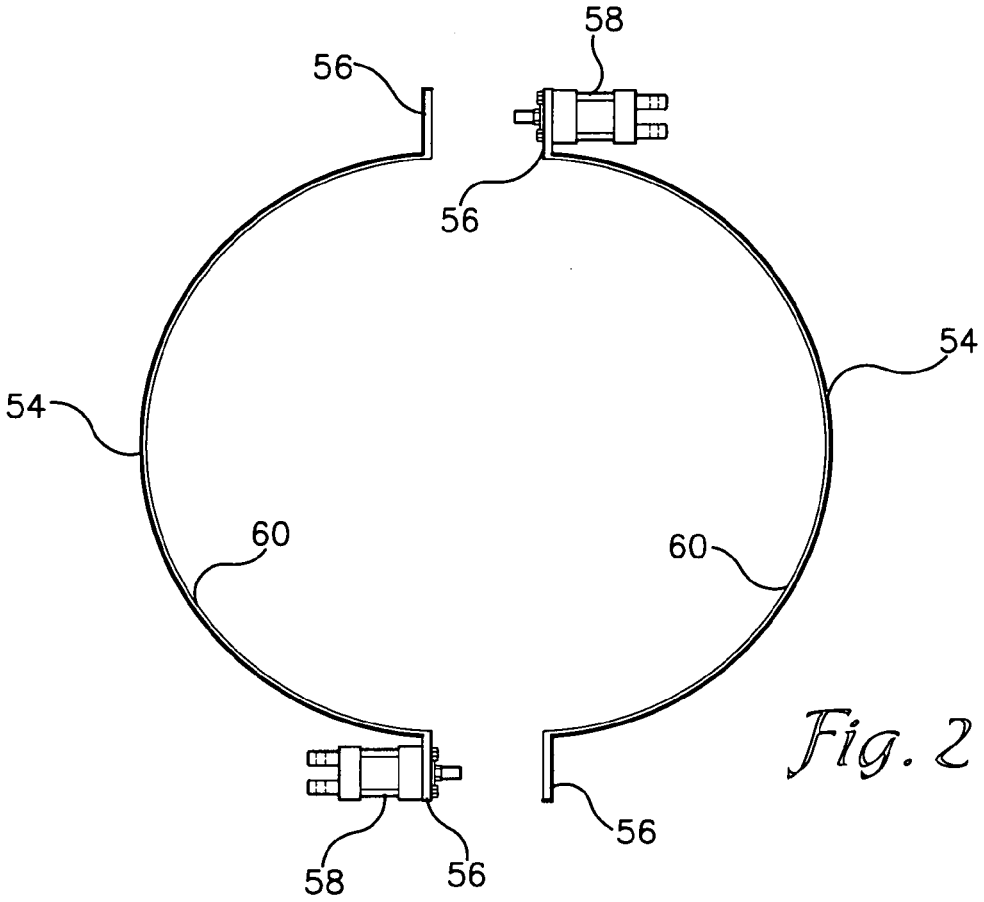
FIG. 2 is a top view of a clamping ring for use with the pile cleaner apparatus of FIG. 1.

Referring to FIG. 2, the clamping ring 12 is split into two identical semi-circular segments, each having two outwardly projecting tangential flange portions 56 having an aperture. Splitting the clamping ring 12 allows it to be placed about a pile 12 easily and then clamped together by the two hydraulic cylinders 58. A rubber-like relatively soft high-friction material, such a rubber 60 lines the inner surface of the clamping ring 12 to grip the pile 14 tightly without damaging it.

Figure 3:
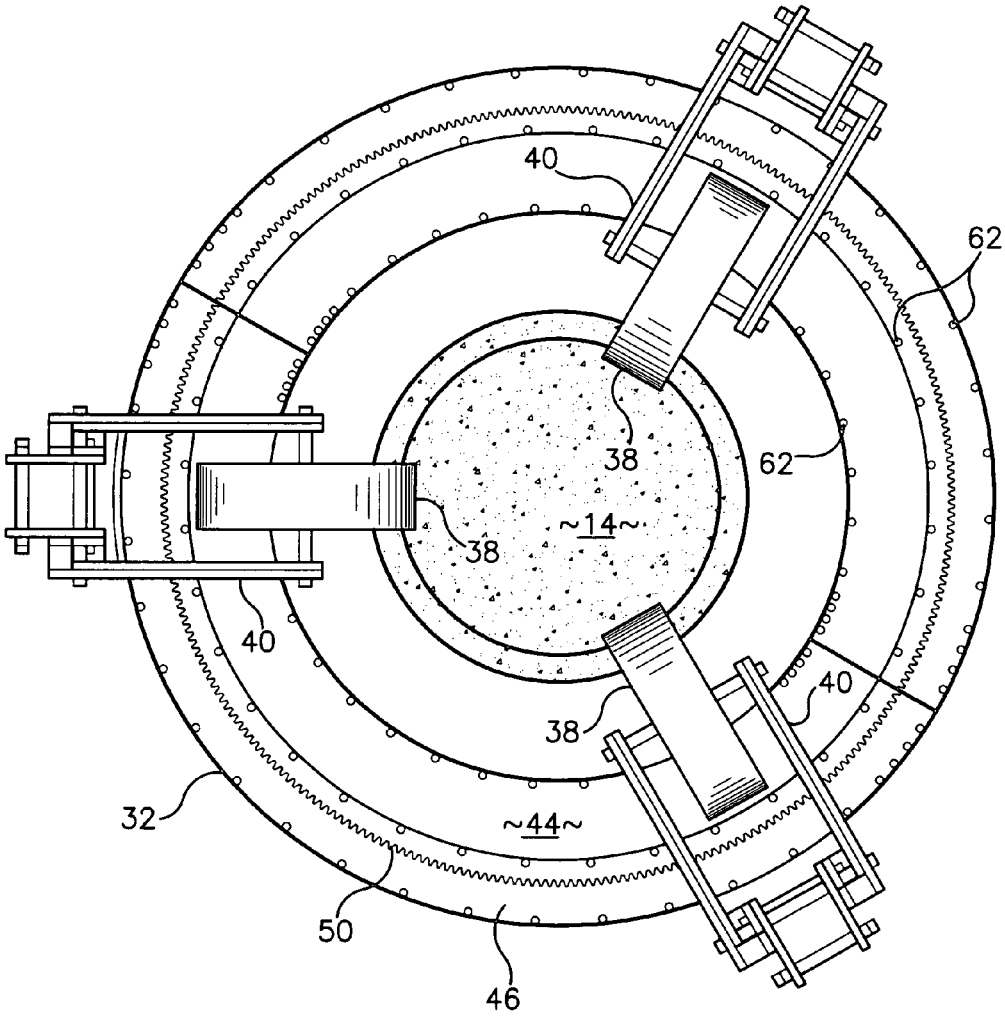
FIG. 3 is a top view of a washing ring assembly for use with the pile cleaner apparatus of FIG. 1 showing an embodiment having three high-pressure water jets for cleaning a pile, with elements of a bottom view.

Referring to FIG. 3, the water jets 38 and associated mounting brackets 40 are actually below the top wall portion 48 and should be shown principally as hidden lines. This embodiment shows three water jets 38, although four are preferred. The preferred material for all the washing ring assembly is aluminum, due to weight considerations, which is assembly almost exclusively by the bolts 62 to insure that the parts are not warped or otherwise deformed by welding or the like. The parts are all machined.

Figure 4:
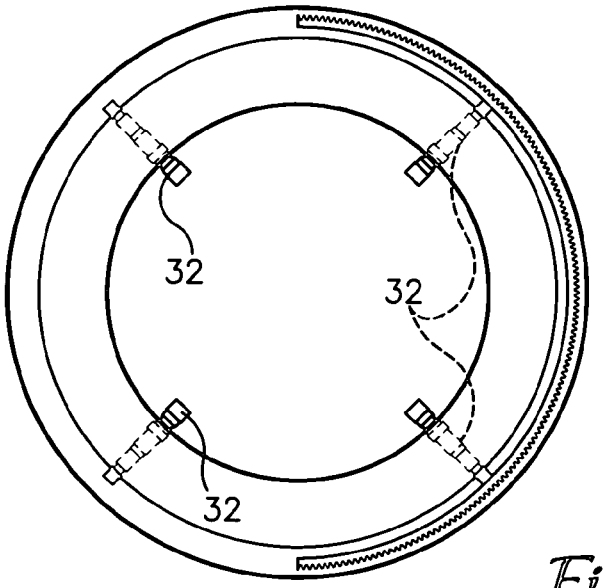
FIG. 4 is a top view of a washing ring assembly for use with the pile cleaner apparatus of FIG. 1 showing an embodiment having the preferred four high-pressure water jets for cleaning a pile.

Referring to FIG. 4, the preferred embodiment includes four water jets 32 spaced apart by 90 degrees along the circumference of the washing ring 44.

Figure 5:
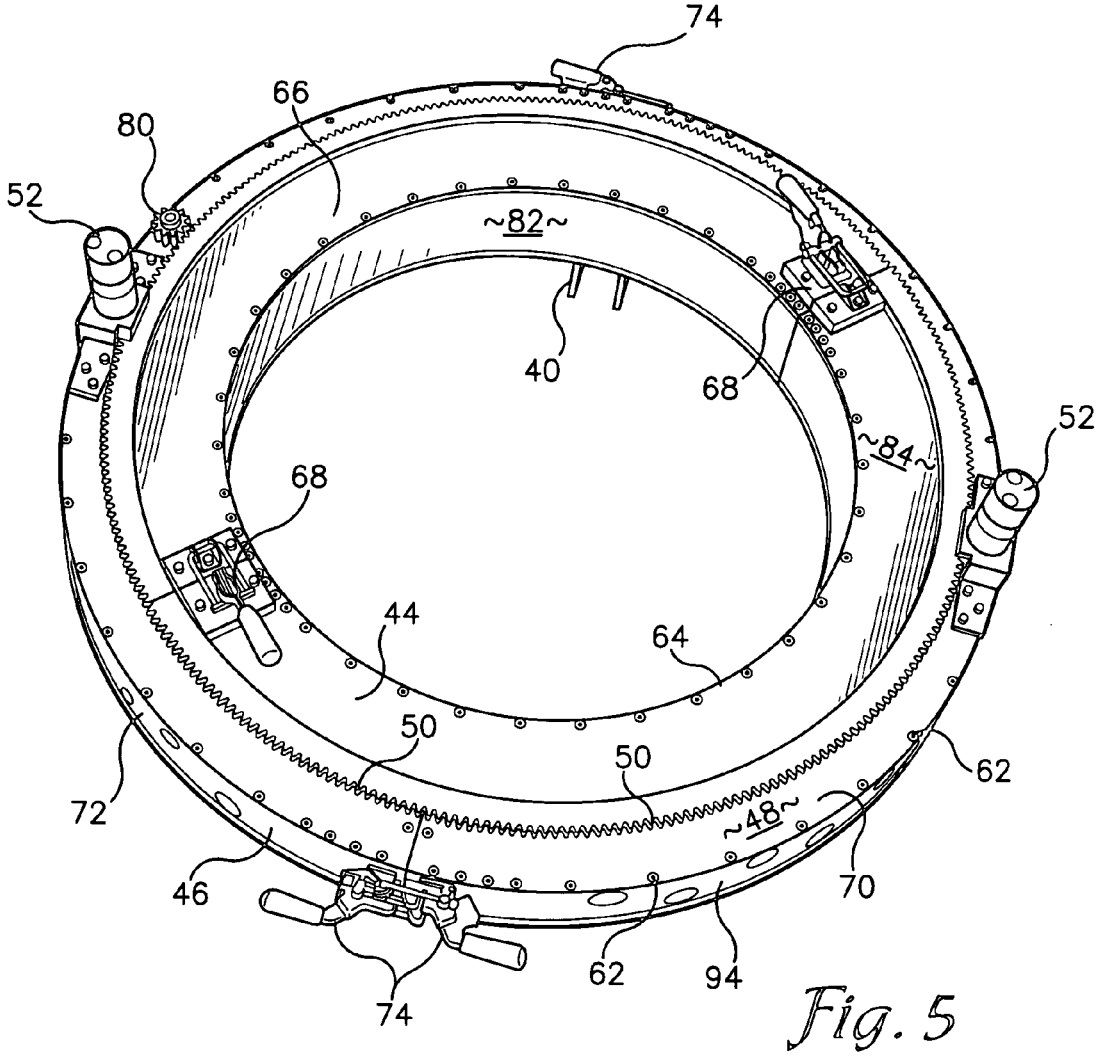
FIG. 5 is a top view of the washing ring assembly of FIG. 1. n isometric view of the automatic pile cleaner of FIG. 1 showing the loosened lower clamping ring being pushed downward by extending the hydraulic rams connecting the upper and lower clamping rings.

Referring to FIG. 5, the washing ring 44 is split into two semicircular sections, 64, 66 which are identical, allowing the disassembled washing ring 44 to be placed about the pile 14 an then fastened together by the four over-center clamps 68, with two of the clamps located on the top surface of the washing ring 44 and two others located on the lower surface of the washing ring 44 directly below the upper over-center clamps. Similarly, the stabilizer ring 46 is split into two semicircular sections 70, 72 that allow the two sections to be placed about a pile 14 and are then fastened together using the four over-center clamps 74. The washing ring 44 is placed over the pile 14 first and then the stabilizer ring 46 is installed.

Figure 6:
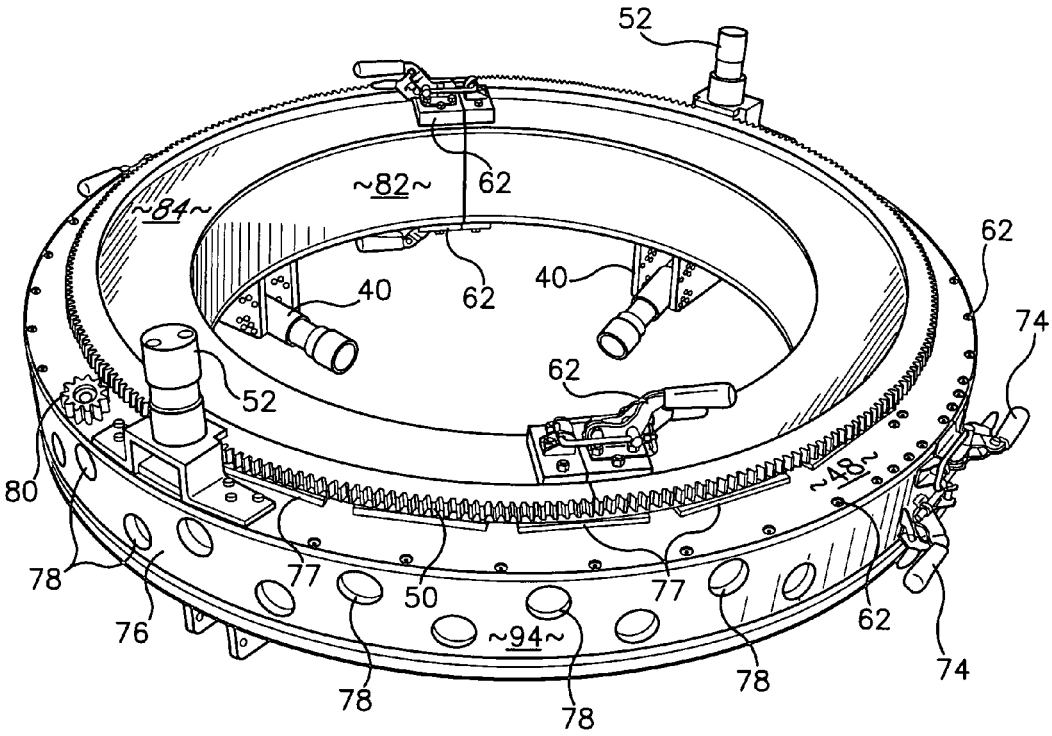
FIG. 6 is an isometric view of the washing ring assembly of FIG. 5.

Referring to FIG. 6, the stabilizer ring 46 includes an outer vertical side wall 76 having a plurality of drain holes 78 in it to drain water and silt. A plurality of friction bearing plates 77 are placed between all mating surfaces of the washing ring 44 and the stabilizer ring 46, which includes the two surfaces shown in FIG. 6, as well as bottom surfaces and the internal vertical side walls of these two parts (see FIG. 8).

Figure 7:
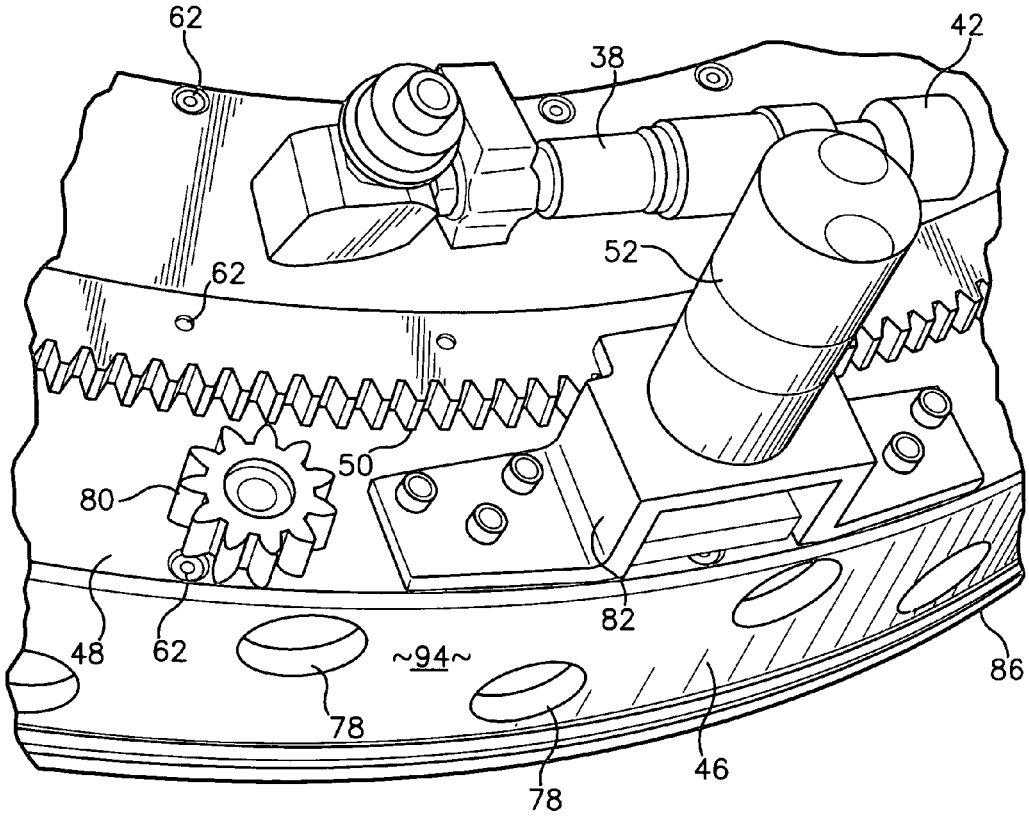
FIG. 7 is an enlarged fragmentary isometric view of the washing ring assembly of FIG. 5 showing the driving ring gear and the driving hydraulic motor and drive gear.

Referring to FIG. 7, the drive gear 80 is shown to the side for illustrative purposes. In use, it is seated inside the drive gear housing 82 and is fixed to the drive shaft of the hydraulic motor 52 and engages and meshes with the ring gear 50 to drive it. About 20 in-pounds of total torque (from the two hydraulic drive motors) will drive the washing ring 46 relative to the stabilizer ring 44. An actual water jet 38, unattached to the larger apparatus, is also visible in FIG. 7.

Figure 8:
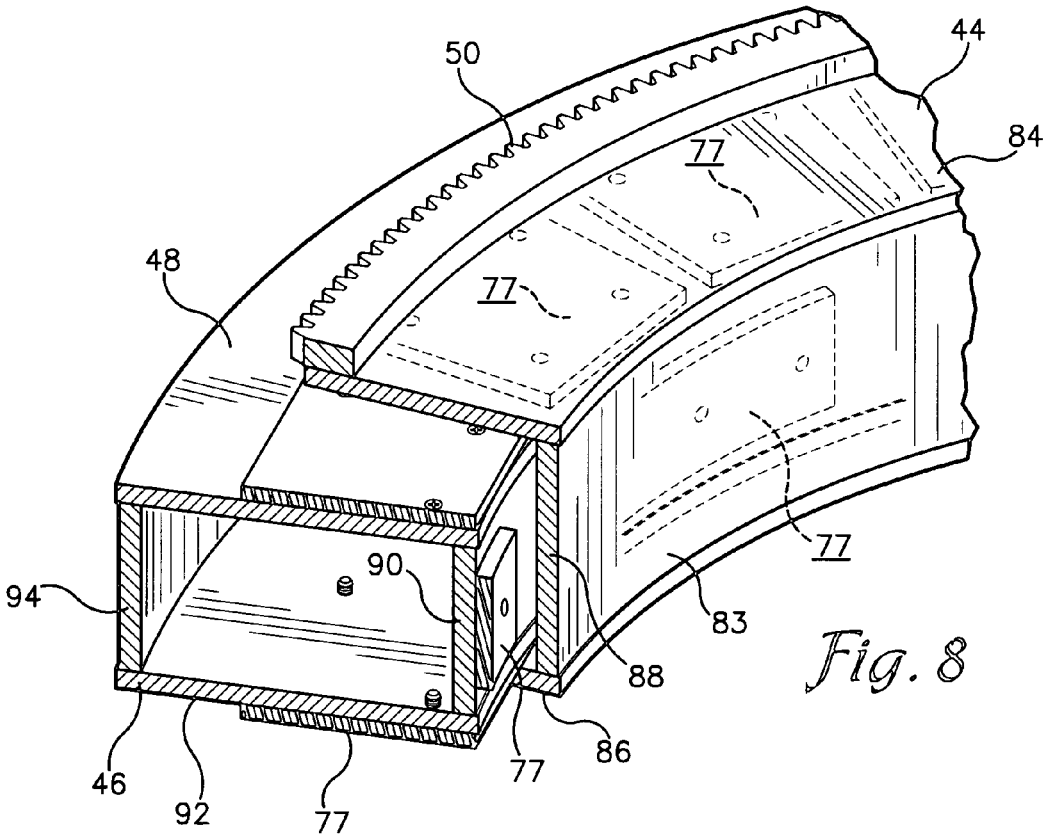
FIG. 8 is a fragmentary isometric cross section view of the washing ring assembly of FIG. 5.

Referring to FIG. 8, the washing ring 44 includes an inner vertical side wall 83, a horizontal top wall 84 and a horizontal bottom wall 86, forming a C-shaped channel 88, which receives the greater portion of the stabilizer ring 46, which is a toroid with a box-shaped cross section, that is four side walls, which are the horizontal top side wall 48, the inner vertical side wall 90, a horizontal bottom side wall 92 and a vertical outer side wall 94. The friction bearings 77 are found on all three contact planes.

Figure 9:
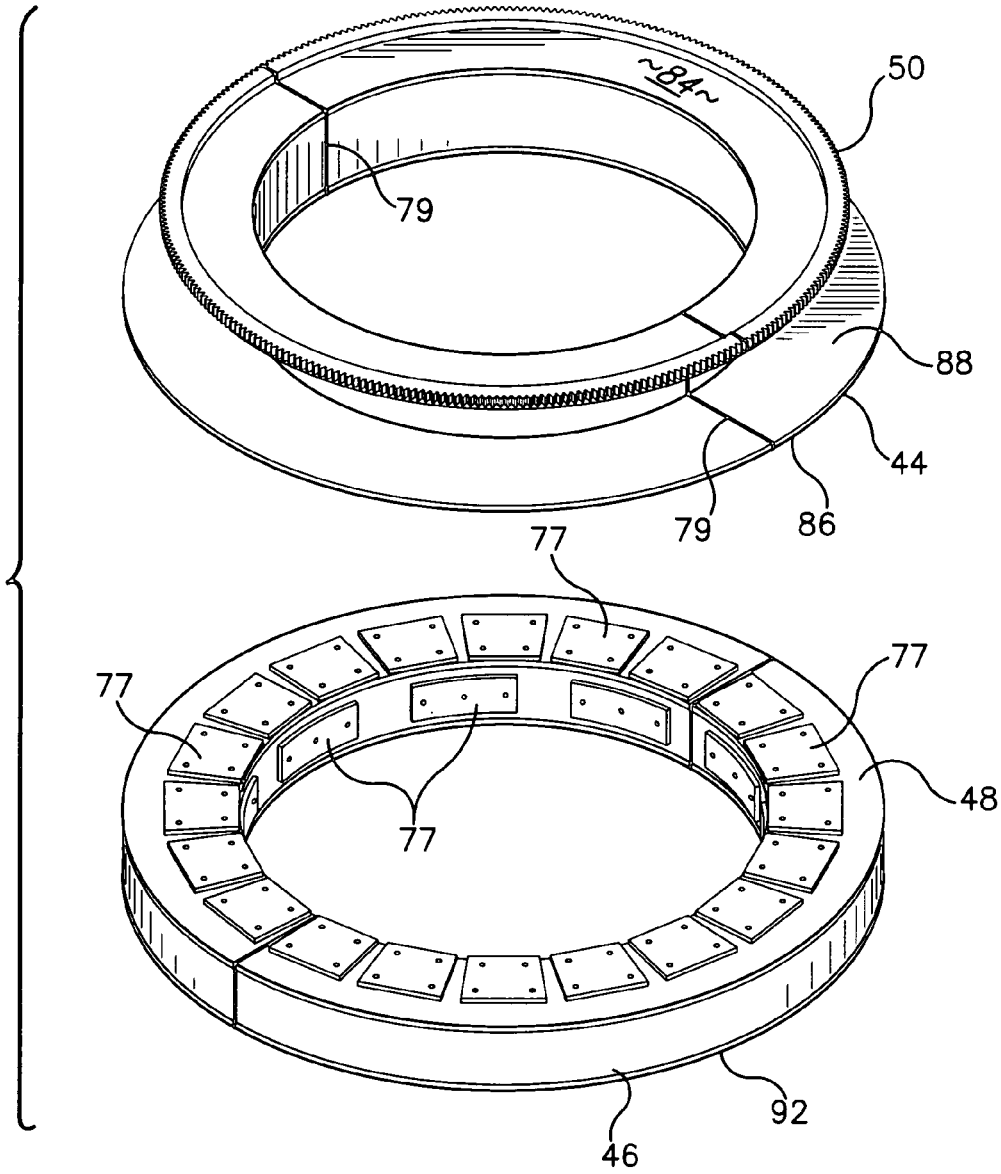
FIG. 9 is an isometric exploded view showing the principal components of the washing ring assembly, which are the oscillating washing ring and the stationary stabilizing ring

Referring to FIG. 9, the washing ring 44, which oscillates, and the stationary stabilizer ring 46 are shown separately assembled, clearly showing that the two parts must be split into two or more sections, as discussed above, in order to place them about a pile 14 and in order to assemble them into one ring member as shown, for example, in FIGS. 6-8. The split line 79 shows where the washing ring 44 is divided into two semi-circular sections and the split line 81 shows where the stabilizer ring 46 is divided into two semi-circular sections for assembly and disassembly, as described above.

Figure 10:
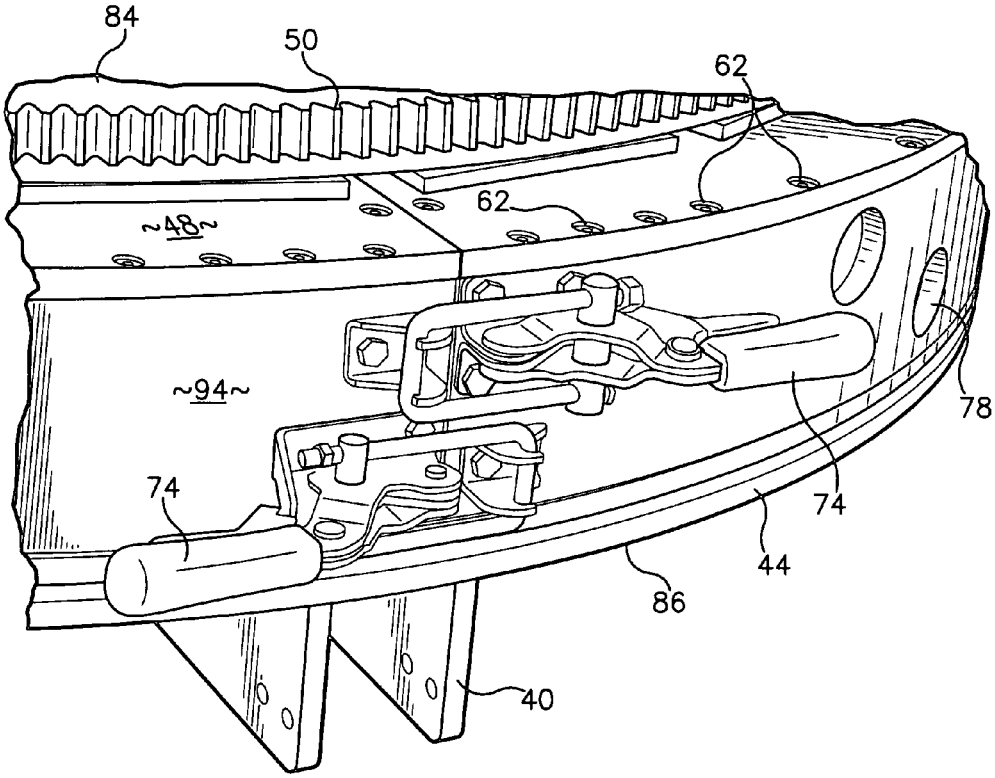
FIG. 10 is an enlarged fragmentary isometric view of the stabilizing ring of the washing ring assembly, showing the over-center clamps used to secure the two semi-circular sections of the stabilizing ring together.

Referring to FIG. 10, it is clearly shown that two separate over-center clamps 74 are used on the outer vertical side wall 94 to fasten the two sections of the stabilizer ring 46 together, with two such over-center clamps 74 used at both joints formed by the mating of the two semi-circular sections, for a total of four over-center clamps 74 on the stabilizer ring 46.

The pile cleaner apparatus 10 can be built to any desired dimensions, with an inside diameter of about 55 inches being capable of being used on piles having diameters in the range of about 18-36 inches. The nozzles 42 can be moved closer to a pile 14 or farther from a pile 14 by using different apertures in the mounting brackets 40. The water jets 38 work best when the nozzles 42 are about 2-3 inches from the work.

While the present invention has been described in accordance with the preferred embodiments thereof, the description is for illustration only and should not be construed as limiting the scope of the invention. Various changes and modifications may be made by those skilled in the art without departing from the spirit and scope of the invention as defined by the following claims.

The invention claimed is:

1. An apparatus for cleaning vertical piles comprising:

a. a clamping ring for clamping around a vertical pile clamped to a vertical pile;

b. a washing ring assembly;

c. means for suspending said washing ring assembly from said clamping ring, with said clamping ring and said washing ring superposed relative to each other and with said washing ring below said clamping ring;

d. means for cleaning the pile with high pressure water connected to said washing ring assembly; and e. means for raising and lowering said washing ring assembly relative to said clamping ring.

2. An apparatus for cleaning piles in accordance with claim 1 further comprising means for oscillating a washing ring section of said washing ring assembly within a stationary stabilizer ring of said washing ring assembly.

3. An apparatus for cleaning piles in accordance with claim 2 wherein said oscillating means further comprises a ring gear, having gear teeth along its outer circumference, mounted on said washing ring section of said washing ring assembly and a drive gear, having gear teeth about its periphery, mounted on said stationary stabilizer ring of said washing ring assembly, wherein said drive gear engages said ring gear, and means for driving said drive gear.

4. An apparatus for cleaning piles in accordance with claim 3 further comprising friction bearings between said stationary stabilizer ring of said washing ring assembly and said washing ring section of said washing ring assembly.

5. An apparatus for cleaning piles in accordance with claim 3 wherein said stationary washing section of said washing ring assembly further comprises a C-shaped cross section washing section in which said stationary washing section is seated and a plurality of drain holes spaced about the circumference of said stationary washing ring.

6. An apparatus for cleaning piles in accordance with claim 5 wherein said cleaning means further comprises a plurality of high pressure water jets pivotally mounted into water jet brackets fixed to said washing ring section.

7. An apparatus for cleaning piles in accordance with claim 1 wherein said clamping ring further comprises at least two separate arcuate segments joined together around the pile to form said clamping ring.

8. An apparatus for cleaning piles in accordance with claim 1 wherein said washing ring assembly further comprises at least two separate arcuate segments joined together around the pile to form said washing ring assembly.

9. An apparatus for cleaning piles in accordance with claim 1 further comprising means for raising or lowering the pile cleaner apparatus up and down along said vertical pile, wherein said raising and lowering means is mounted on said clamping ring.

10. An apparatus for cleaning piles in accordance with claim 9 wherein said raising or lowering means further comprises at least two drive wheels pivotally mounted on said clamping ring for engagement with the said vertical pile and means for driving said at least two drive wheels.

11. An apparatus for cleaning piles in accordance with claim 1 wherein said said raising and lowering means further comprises at least four pulleys attached to said washing ring assembly, at least three pulleys attached to said clamping ring, a cable threaded about said pulleys and a winch for shortening or lengthening the distance between said washing ring assembly and said clamping ring.

12. An apparatus for cleaning piles comprising:

a. a clamping ring for clamping around a pile;

b. a washing ring assembly;

c. means for suspending said washing ring from said clamping ring;

d. means for cleaning the pile with high pressure water connected so said washing ring assembly; and e. said suspension means further comprising means for raising and lowering said washing ring assembly relative to said clamping ring and wherein said raising and lowering means further comprises at least four pulleys attached to said washing ring assembly, at least three pulleys attached to said clamping ring, a cable threaded about said pulleys and a winch for shortening or lengthening the distance between said washing ring assembly and said clamping ring.

13. An apparatus for cleaning piles comprising:

a. a clamping ring for clamping around a pile, said clamping ring further comprising two semi-circular sections fastened together about a pile and means for holding the two semi-circular sections together, clamping the pile;

b. a washing ring assembly comprising a stationary stabilizer ring seated into a circumferential C-shaped channel in a washing ring section;

c. a plurality of lower pulleys mounted on said washing ring assembly and a plurality of upper pulleys mounted on said clamping ring and a cable threaded about said lower and upper pulleys and fastened at one end to a winch mounted on said clamping ring for raising or lowering said washing ring assembly relative to said clamping ring assembly; and d. a plurality of high pressure water jets pivotally mounted on said washing ring section of said washing ring assembly, each said high pressure water jet further comprising a nozzle aimed at the pile; and e. means for raising or lowering the pile cleaner apparatus up and down along said pile, wherein said raising and lowering means is mounted on said clamping ring, said raising or lowering means further comprises at least two drive wheels pivotally mounted on said clamping ring for engagement with said pile and means for driving said at least two drive wheels.

14. An apparatus for cleaning piles in accordance with claim 13 wherein said washing ring assembly further comprises at least two separate segments joined together around the pile to form said washing ring assembly.

* * * * *